US005118906A

United States Patent [19]

Kudoh et al.

[11] Patent Number: 5,118,906

[45] Date of Patent: Jun. 2, 1992

[54] WIRE CONDUCTORS FOR AUTOMOBILES

[75] Inventors: Kazunao Kudoh; Fukuma Sakamoto, both of Itami; Kazunori Tsuji, Suzuka, all of Japan

[73] Assignees: Sumitomo Electric Industries, Ltd., Osaka; Sumitomo Wiring Systems, Ltd., Mie, both of Japan

[21] Appl. No.: 626,293

[22] Filed: Dec. 12, 1990

[30] Foreign Application Priority Data

Dec. 14, 1989 [JP] Japan ..... 1-325698
Dec. 14, 1989 [JP] Japan ..... 1-325699
Dec. 14, 1989 [JP] Japan ..... 1-325700

[51] Int. Cl.[5] ..... H01B 5/08

[52] U.S. Cl. ..... 174/130; 174/126.2; 174/128.1; 57/212; 57/218; 57/314; 428/677; 29/872; 156/51

[58] Field of Search ..... 174/130, 128.1, 126.2; 57/212, 213, 214, 218, 200, 206, 236, 238, 314; 428/607, 677, 931; 148/11.5 Q, 12 B, 127

[56] References Cited

U.S. PATENT DOCUMENTS

| | | | |
|---|---|---|---|
| 2,317,350 | 4/1943 | Adler et al. | 428/677 X |
| 2,420,291 | 5/1947 | Adler | 428/677 |
| 2,918,722 | 12/1959 | Kenmore | 428/658 |
| 3,490,125 | 1/1970 | Frieling, Jr. | 428/677 |
| 3,795,760 | 3/1974 | Raw et al. | 174/110 R X |
| 4,582,545 | 4/1986 | Kamada et al. | 148/11.5 C |
| 4,810,593 | 3/1989 | Yamamoto et al. | 148/12 B X |

*Primary Examiner*—Morris H. Nimmo
*Attorney, Agent, or Firm*—Wenderoth, Lind & Ponack

[57] ABSTRACT

An electric wire conductor for use in automobiles made by twisting a plurality of strands together. Each of the strands has a surface layer made of copper or a copper alloy and a core made of steel containing carbon and other elements such as Si, Mn, Ni and Cr. Also, the core may be made of an Fe-based alloy containing Ni or Cr. This structure allows a substantial reduction in the weight of conductor.

6 Claims, 1 Drawing Sheet

WIRE CONDUCTORS FOR AUTOMOBILES

This invention relates to a lightweight electric wire conductor for automobiles.

As an electric wire conductor used for wiring in automobiles, a wire made by twisting wires made of annealed copper (under JIS C 3120) or those plated with tin was heretofore used. The wire is then covered with an insulating material such as vinyl chloride, crosslinked vinyl or crosslinked polyethylene.

Modern cars have an increasing number control circuits to achieve high performance and as a result the number of wiring points is increasing. This has lead to an ever increasing demand for lighter wires while maintaining high reliability. Thus, the above-described conventional wire conductors are rapidly losing popularity.

Although most of electric wires for control circuits, which account for a large percentage of the wires, have a permissible current of 1 ampere or less since they are used merely to pass signal currents, it was heretofore necessary to use wires having a larger diameter than electrically necessary in order to assure their mechanical strength.

As one solution for achieving lightness in weight of such wires, consideration was given to the use of aluminum (including its alloy; all references to aluminum should be so understood hereinafter) as a material for the conductors. Also, wires made of copper alloy containing 0.3–0.9 percent of tin and ones made of phosphor bronze containing 4 –8 percent of tin have been developed (Japanese Patent Examined Publications 60-30043 and 61-29133) and are now in actual use.

Since aluminum is poor in strength, the wires made of aluminum have to have an increased outer diameter or be made of an increased number of strands to be twisted together in order to achieve a sufficient strength. This will lead to increases in the amount of insulating material used and in the wiring space, which will in turn result in increased cost and make it more difficult to decrease the weight of the wires.

The wiring in an automobile requires the use of a great number of terminals. This poses such problems as electrical corrosion at the terminals and deterioration of solderability.

On the other hand, the wire conductors disclosed in the abovementioned publications show an increased strength due to the addition of tin to copper, which in turn makes it possible to reduce the sectional area of the conductor twisted together. But even with these wires the minimum value of the sectional area is higher than 0.15–0.3 $mm^2$. If lowered to 0.05–0.15 $mm^2$, the strength will be insufficient. Even if strength is sufficient, the electrical resistance will be too large because the conductivity will be less than 20 percent IACS International Annealed Copper Standard).

It is an object of the present invention to provide an electric wire conductor for use in an automobile which is lighter in weight and reliable.

The wire conductor for automobiles according to the first embodiment of the present invention is made by twisting a plurality of strands each having a tensile strength of 60–120 kg and a conductivity of 25 percent IACS or more. Its surface layer is made of copper or its alloy and its core is made of steel containing 0.01–0.25 percent of carbon and other elements such as Si,.Mn, P, S, Ni and Cr. The conductor after twisting has a sectional area D of 0.05 –0.30 $mm^2$ and a breaking load T of 6 kg or more.

FIG. 1 shows the section of the first embodiment in which an electric wire conductor 1 is made by twisting seven strands 2 each having a diameter d. In this figure, numeral 3 designates a core of each strand 2. A surface layer 4 of oxygen-free copper covers the core 3.

Supposing that the sectional area of the conductor is the same, it is desirable to use as many strands as possible to assure a good flexibility of the conductor. But it is troublesome to set a large number of fine strands in a twisting machine. Thus, the number of strands used should be 2–37, preferably 7–19.

The content of the surface layer put on the outer periphery of the core of the strand should be 20–80 percent by weight.

The conductivity of the strand should not exceed 80 percent IACS.

The electric wire conductor for automobiles according to the second embodiment of the present invention is made by twisting a plurality of strands each having a tensile strength of 60–140 $kg/mm^2$ and a conductivity of 25 percent IACS or more. Its surface layer is made of copper or its alloy and its core is made of steel containing 0.25–0.85 percent of carbon and other elements such as Si, Mn, P, S, Ni and Cr. The conductor after twisting should have a total sectional area D of 0.05–0.30 $mm^2$ and a breaking load T of 6 kg or more. This embodiment is the same as the first embodiment in other points.

The electric wire conductor for automobiles according to the third embodiment of the present invention is made by twisting a plurality of strands each having a tensile strength of 60–140 $kg/mm^2$ and a conductivity of 25 percent IACS or more. Its surface layer is made of copper or its alloy and its core is made of an iron-based alloy containing Ni, Cr, Si and Mn. The conductor after twisting should have a total sectional area D of 0.05–0.30 $mm^2$ and a breaking load T of 6 kg or more. This embodiment, too, is the same as the first embodiment in other points.

The metallic elements other than Fe contained in the core may include, besides the abovementioned elements, Co, Mo or Nb. The core should contain 20–80 percent by weight of one or more of Ni, Cr, Si, Mn, Co, Mo and Nb with the remainder being iron.

In the first embodiment, by using a composite material having a covering of copper (or its alloy) as an element conductor or strand, the conductivity required (25 percent IACS or more) and a good solderability are achieved by the covering copper.

Also, since a steel wire containing 0.01–0.25 percent of carbon is used as the core, the conductor has a higher tensile breaking load T, a higher terminal housing retainability and a higher flexibility than conventional conductors. This makes it possible to reduce the sectional area and the weight of the conductor after twisting.

In the first embodiment, the tensile strength t should be within 60–120 $kg/mm^2$. This is because if less than 60 $kg/mm^2$, the load at break of the conductor will be 6 kg or less, if the conductor is made up of seven strands and the total sectional area D is 0.1 $mm^2$. Such a wire will be more liable to breakage and cannot retain a terminal with a sufficient force. On the other hand, in view of the characteristics of the steel wires used, it would be impossible to achieve a t value of more than 120 $kg/mm^2$. Considering the terminal retaining force, the tensile strength t should be preferably 80–110 $kg/mm^2$.

The conductivity of each strand is set at 25 percent IACS or more. This value was obtained by calculating the permissible current from the electrical resistance of the conductor composed of strands having their surface layer formed of oxygen-free copper or copper alloy. Supposing that the lower limit of the permissible current is 1 ampere, the conductivity should be 25 percent or more, preferably 30 -40 percent IACS or more. In order to maintain the required tensile strength by use of the composite material, the conductivity should not exceed 80 percent IACS. If larger, the tensile strength will have to be sacrificed.

The total sectional area D of the conductor after twisting is set at 0.05–0.30 $mm^2$. If more than 0.30 $mm^2$, the required strength can be obtained even with a conventional conductor, but it is impossible to achieve decrease in weight. On the other hand, if less than 0.05 $mm^2$, the conductor will be liable to deform by tensile force provided the conductor has a T value of 5 kg or less and is composed of seven strands having a diameter of 0.08 mm. More preferably, the D value should be 0.07–0.20 $mm^2$.

With a conventional annealed copper wire, the lower limit of the total sectional area D is 0.3 $mm^2$. In case of a copper wire containing tin (0.3–0.9 percent), the lower limit of the D value is ordinarily 0.2 $mm^2$. In contrast, according to the present invention, even if the D value is around 0.1 $mm^2$, the strength equivalent to that of a conventional wire having a D value of 0.3 $mm^2$ can be expected. This will permit reduction in weight of the conductor (for example, if D is 0.1 $mm^2$, the weight will be 60 percent less than the 0.3 $mm^2$ structure).

The content of carbon in the core of each strand should be 0.01–0.25 percent. If less than 0.01 percent, it will be difficult to achieve a tensile strength t of 60 $kg/mm^2$ or more. If more than 0.25 percent, the intermediate thermal treatment will become difficult. Without special thermal treatment, it would be difficult to obtain a material having a high yield strength, i.e. a material which is flexible and difficult to break. Further, the steel may contain a deoxidizer, 0.3 percent or less of Si and 1.5 percent or less of Mn, and small amounts of P, S, Ni and Cr to prevent brittleness.

In the second embodiment, since a copper wire containing 0.25–0.85 percent of carbon is used as a core of each strand, the conductor has a higher tensile load at break T, a higher terminal housing retaining force and a higher flexibility than conventional conductors. This leads to reductions in the total sectional area and thus the weight of the conductor after twisting.

In the second embodiment, the tensile strength t should be within 60–140 $kg.mm^2$. This is because if less than 60 $kg/mm^2$, the load at break of the conductor will be 6 kg or less if the conductor is made up of seven strands, when the total sectional area D is 0.1 $mm^2$. Such a wire will be more liable to breakage and cannot retain a terminal with a sufficient force. On the other hand, in view of the characteristics of the steel wires used, it would be impossible to achieve a t value of more than 140 $kg/mm^2$. Considering the terminal retaining force, the tensile strength t should preferably be 80–130 $kg/mm^2$.

With a conventional annealed copper wire, the lower limit of the total sectional area D is 0.5 $mm^2$. In case of a copper wire containing tin (0.3–0.9 percent), the lower limit of the D value is ordinarily 0.2 $mm^2$. In contrast, according to the second embodiment of the present invention, even if the D value is around 0.1 $mm^2$, the strength equivalent to that of a conventional wire having a D value of 0.3 $mm^2$ can be expected. This will permit reduction in weight of the conductor (for example, if D is 0.1 $mm^2$, the weight will be 60 percent less than the 0.3 $mm^2$ structure).

The content of carbon in the core of each strand should be within the range of 0.25–0.85 percent. If less than 0.25 percent, it will be difficult to achieve a tensile strength t of 100 $kg/mm^2$ or more, preferably 120 $kg/mm^2$ or more. If the content of carbon is 0.25 percent or more, it will be difficult to obtain a material having a high yield strength, i.e. a material which is flexible and difficult to break. If steel wires containing 0.25 percent or more, preferably 0.40 percent or more of carbon are used, they should be heated to a temperature higher than the Al critical temperature (723° C.) and then subjected to patenting to turn them into a bainite structure. The strands thus obtained have a good workability as well as high strength. If the carbon content is more than 0.85 percent or more, the steel wires will be so hard that even after patenting they will be extremely difficult to draw.

In the third embodiment, since an Fe-based alloy wire is used as the core of each strand, the conductor has a higher tensile breaking load T, a higher terminal retaining force and a higher flexibility than conventional conductors. This leads to reductions in the total sectional area and thus the weight of the conductor after twisting.

In the third embodiment, the tensile strength t should be within 60–140 $kg/mm^2$. This is because if less than 60 $kg/mm^2$, the breaking load of the conductor will be 6 kg or less if the conductor is made up of six strands and has a total sectional area D of 0.1 $mm^2$. Such a wire will be more liable to breakage and cannot retain terminals with a sufficient force. On the other hand, it is would be preferable to increase the t value to more than 140 $kg/mm^2$, but such wires would be very special and thus costly. Thus, taking into consideration the terminal retaining force, the tensile strength t should preferably be 80–120 $kg/mm^2$ because within this range, ordinary materials can be used.

Of the components contained in the Fe-based alloy of the core, the content of one or more of Ni, Co, Cr, Si, Mn, Mo and Nb should preferably be 20–80 percent by weight, because within this range the cost can be kept down to a minimum while achieving the required tensile strength.

Namely, the tensile strength of an Fe-based material can be increased by adding such elements as Ni and Cr. For example, the tensile strength increases to 70–80 $kg/mm^2$ by adding only 20 percent or more of Ni or Cr. If the content of the above elements plus Si, Mn and Cr is 20 percent or more, the tensile strength will be 100–140 $kg/mm^2$. But this does not mean that the tensile force increases in proportion to the content of such elements. Within the range of 20–80 percent, the tensile strength can be increased sufficiently without wasting these expensive elements.

Generally, known alloys which can be used for the core of the conductor according to the present invention include an Fe-Ni alloy containing 36–52 percent of Ni and about 1 percent of Si and Mn with the remainder being iron, a stainless steel containing 15–25 percent of Cr, 3–10 percent of Ni and about 1 percent of Si and Mn with the remainder being iron, or a high tensile strength inbar or a high tensile strength stainless steel having an increased strength by adding Mo or Nb to the above-said stainless steel.

According to this invention, the weight of the electric wire conductor can be reduced remarkably while keeping the terminal housing retaining force, tensile breaking load mechanical properties such as flexing resistance, electrical properties and solderability at satisfactory levels. This prevents increases in the weight and space of wiring due to increase in the wiring points, thereby reducing the amount of insulating material used and thus the cost.

Other features and objects of the present invention will become apparent from the following description taken with reference to the accompanying drawings, in which.

First Embodiment

Figure 1:
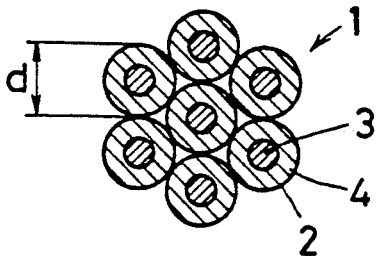
FIG. 1 is a sectional view embodying the present invention.

As core materials for strands of specimens Nos. 1–4 of the first embodiment (shown in table 1), four different kinds of steel rods having a diameter of 8 mm and different carbon contents were prepared. They also contained Si (0.1 –0.3%) and Mn (0.6–1.3%). As the covering copper tubes for the specimen Nos. 1–3, tubes made of oxygen-free copper (under JIS 3510) (hereinafter referred to as OFC tubes) were prepared and as a covering for the specimen No. 4, a copper tube containing 0.3% of Sn was prepared. These covering copper tubes are straight tubes 16 mm in external diameter and 12 mm internal diameter.

Next, in order to make composite strands from these materials, the above steel rods were inserted into the OFC tubes and the Sn-containing copper tube while dry-polishing (shot blast polishing) their surfaces. The resulting materials were drawn by a die to reduce the diameter to about 10 mm. The copper composite materials thus obtained for specimens Nos. 1–4 showed a conductivity of about 40%, about 60%, about 30% and about 20%, respectively.

These materials were subjected to repeated drawings and softenings to reduce the diameter to 0.5 mm. After final softening at 600°–800° C. for about one hour, they were drawn to a diameter of 0.127 mm. The covering layer was thus metallurgically bonded to the core material. The tensile strength t and the conductivity of the strands thus obtained are shown in Table 1.

Second Embodiment

As core materials for strands of specimens Nos. 1–4 of the second embodiment (shown in Table 2), four different kinds of steel rods having a diameter of 8 mm and different carbon contents were prepared. As the covering copper tubes for the specimens Nos. 1–3, tubes made of oxygen-free copper (under JIS 3510) were prepared and as a covering for the specimen No. 4, a copper tube containing 0.3% of Sn was prepared. These covering copper tubes are straight tubes 16 mm in external diameter and 12 mm in internal diameter.

Next, in order to obtain composite strands from these materials, the above steel rods were inserted into the OFC tubes and the Sn-containing copper tube while dry-polishing (shot blast polishing) their surfaces and the resulting materials were drawn by a die to reduce the diameter to 10 mm. The copper composite materials thus obtained for specimens Nos. 1–4 showed a conductivity of about 40%, about 60%, about 30% and about 20%, respectively.

These materials were subjected to repeated drawings and softenings to reduce the diameter to 0.5 mm. After subjecting these materials to a special patenting as the final softening, they were drawn to a diameter of 0.127 mm. The tensile strength t and the conductivity of the st thus obtained are shown in Table 2.

Third Embodiment

As the core materials for the strands of the specimens 1–5 of the third embodiment (shown in Table 3), three different kinds of rods 8 mm in diameter were prepared, i.e. an inbar containing 36% of Ni, 1.2% of Mo, 1.0% of Mn and 0.3% of Si with the remainder being Fe, an Fe-Ni alloy containing 42% of Ni, 1.0% of Mn and 0.2% of Si with the remainder being Fe, and a stainless steel containing 18% of Cr and 8% of Ni with the remainder being Fe. As the covering copper tubes, OFC tubes 16 mm in external diameter and 12 mm in internal diameter were prepared.

Next, in order to obtain composite strands from these materials, the above steel rods were inserted into the OFC tubes while dry-polishing (shot blast polishing) their surfaces and the resulting materials were drawn by a die to reduce the diameter to 10 mm. The copper composite materials thus obtained for specimens Nos. 1–3 showed a conductivity of about 40%, about 65% and about 60%, respectively.

These materials were subjected to repeated drawings and softenings to reduce the diameter to 0.5 mm. After subjecting these materials to final softening at 600°–900° C. for about an hour, they were drawn to a diameter of 0.127 mm. The tensile strength t and conductivity of the thus obtained strands are shown in the Table 3.

TESTING

Thereafter, seven strands of the respective embodiments were twisted together to form wire conductors having a total sectional area D of 0.08–0.1 $mm^2$. They were then covered with vinyl chloride to a thickness of 0.2 mm for use as electric wires for automobiles.

Various characteristics of these wire conductors!are shown in Tables 1–3 together with those of conventional and comparative materials.

For electric wires for automobiles, the terminal housing retaining force is an important property for high reliability of the connecting portions to terminals. To evaluate this property, after connecting each conductor to a terminal by compressed bonding, it was pulled by a tension tester to measure the load when it comes out of the connecting portion (or when it is broken). Such retaining force should be 7 kg or more, preferably 10 kg or more.

Also, the tensile breaking load should preferably be about 10 kg or more as far as the flexibility of the conductor is not lost.

Figure 2:
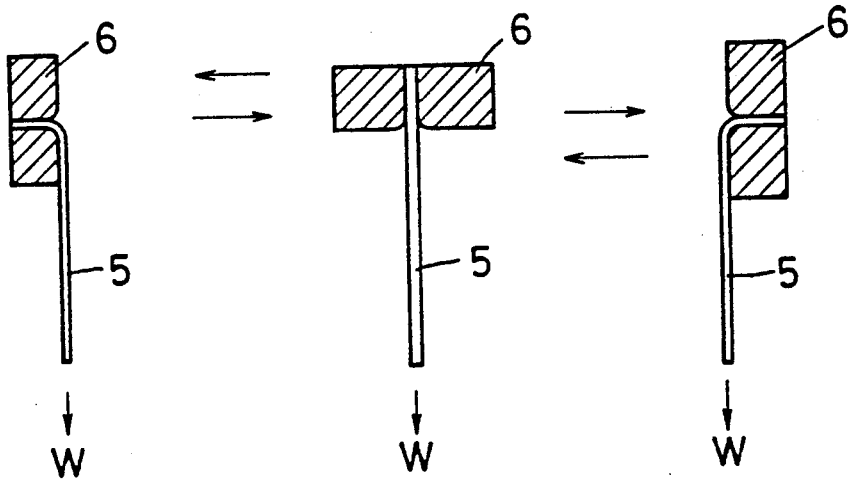
FIG. 2 is a view for explaining how the flexing test was done.

Also, the electric wire should have a flexing resistance high enough not to get broken when bent repeatedly near the terminal. To measure the flexing resistance, an electric wire 5 having a covering was held by a jig 6 shown in FIG. 2 and bent right and left by an angle of 90 degrees in each direction, with the load W of 500 g put on one end thereof. The flexing resistance was given in terms of the number of reciprocating motions of the wire done without being broken.

As for the solderability, after immersing the specimens in white rosin flux, they were immersed in eutectic solder kept at 230° C. for 2 seconds and the area ratio of the surface wet with molten solder to the entire immersed surface area was measured. A good mark was given for 90% or more and a bad mark was given for less than 90%.

As is apparent from the data in the Tables, comparing the electric wires according to the present invention with the conventional wires, the conductors having a total sectional area of 0.3 mm² (Specimen No. 5 in Tables 1 and 2 and No. 6 in Table 3) weigh 5.0 g/m whereas the conductors having a total sectional area of 0.1 mm² (specimen Nos. 1–4 in Tables 1 and 2 and Specimen No. 1–5 in Table 3) weigh 1.4–1.5 g/m. In other words, the weight was reduced about 3.5 g/m or 70 percent. As for the strength, the wires according to the present invention were substantially the same as the conventional wires.

TABLE 1

| No. | Material for conductor | Structure of conductor | Conductor outer dia. (mm) | Element conductor's characteristics: Conductivity (% IACS) | Element conductor's characteristics: Tensile strength (kg/mm²) | Conductor weight (g/m) | Wire weight after covering (g/m) | Conductor tensile break load (kg) |
|---|---|---|---|---|---|---|---|---|
| Present invention | | | | | | | | |
| 1 | OFC - clad 0.1% C steel | 7/0.127ϕ | 0.4 | 40.5 | 98.5 | 0.84 | 1.4 | 11.5 |
| 2 | OFC - clad 0.22% C steel | " | " | 60.0 | 101.5 | 0.86 | 1.5 | 12.6 |
| 3 | OFC - clad 0.02% C steel | " | " | 29.0 | 68.5 | 0.83 | 1.4 | 8.0 |
| 4 | 0.13% C steel clad with Cu containing 0.3% Sn | " | " | 26.0 | 110 | 0.84 | 1.4 | 10.9 |
| Prior art | | | | | | | | |
| 5 | Tough pitch soft copper | 7/0.26ϕ | 0.78 | 100 | 28 | 3.4 | 5.0 | 10.6 |
| 6 | Cu-0.62% Sn alloy | 7/0.2ϕ | 0.60 | 60 | 53 | 2.0 | 4.2 | 11.9 |
| Comparative ex. | | | | | | | | |
| 7 | Aluminum | 7/0.32ϕ | 0.96 | 63 | 23 | 1.5 | 5.0 | 4.2 |
| 8 | OFC - clad 0.005% C steel | 7/0.127ϕ | 0.4 | 60.5 | 55.6 | 0.85 | 1.5 | 6.8 |
| 9 | OFC - clad 0.32% C steel | " | " | 30.5 | 128 | 0.83 | 1.4 | 12.9 |

| No. | Material for conductor | Terminal housing holding force (kg) | Flexing resistance | Solderability |
|---|---|---|---|---|
| Present invention | | | | |
| 1 | OFC - clad 0.1% C steel | 10.0 | 9350 | Good |
| 2 | OFC - clad 0.22% C steel | 10.2 | 9480 | " |
| 3 | OFC - clad 0.02% C steel | 7.6 | 9350 | " |
| 4 | 0.13% C steel clad with Cu containing 0.3% Sn | 10.0 | 9216 | " |
| Prior art | | | | |
| 5 | Tough pitch soft copper | 10.0 | 5500 | " |
| 6 | Cu-0.62% Sn alloy | 11.0 | 7230 | " |
| Comparative ex. | | | | |
| 7 | Aluminum | 4.0 | 3200 | Bad |
| 8 | OFC - clad 0.005% C steel | 6.5 | 9210 | Good |
| 9 | OFC - clad 0.32% C steel | 10.9 | 5800 | " |

TABLE 2

| No. | Material for conductor | Structure of conductor | Conductor outer dia. (mm) | Element conductor's characteristics: Conductivity (% IACS) | Element conductor's characteristics: Tensile strength (kg/mm²) | Conductor weight (g/m) | Wire weight after covering (g/m) | Conductor tensile break load (kg) |
|---|---|---|---|---|---|---|---|---|
| Present invention | | | | | | | | |
| 1 | OFC - clad 0.28% C steel | 7/0.127ϕ | 0.4 | 30.5 | 135 | 0.84 | 1.4 | 13.2 |
| 2 | OFC - clad 0.41% C steel | " | " | 45.2 | 120 | 0.86 | 1.6 | 12.6 |
| 3 | OFC - clad 0.60% C steel | " | " | 63.5 | 118 | 0.86 | " | 11.3 |

TABLE 2-continued

| | | | | | | | | |
|---|---|---|---|---|---|---|---|---|
| 4 | 0.13% C steel clad with Cu containing 0.3% Sn | " | " | 25.5 | 133 | 0.84 | 1.4 | 13.0 |
| Prior art | | | | | | | | |
| 5 | Tough pitch soft copper | 7/0.26ϕ | 0.78 | 100 | 28 | 3.4 | 5.0 | 10.6 |
| 6 | Cu-0.62% Sn alloy | 7/0.20ϕ | 0.6 | 60 | 53 | 2.0 | 4.5 | 11.9 |
| Comparative ex. | | | | | | | | |
| 7 | Aluminum | 7/0.32ϕ | 0.96 | 63 | 23 | 1.5 | 5.0 | 4.2 |
| 8 | OFC - clad 0.20% C steel | 7/0.127ϕ | 0.4 | 40.5 | 100.2 | 0.84 | 1.4 | 10.5 |
| 9 | OFC - clad 0.01% C steel | " | " | 40.3 | 82.6 | " | " | 8.6 |

| No. | Material for conductor | Terminal housing holding force (kg) | Flexing resistance | Solderability |
|---|---|---|---|---|
| Present invention | | | | |
| 1 | OFC - clad 0.28% C steel | 12.6 | 8960 | Good |
| 2 | OFC - clad 0.41% C steel | 12.0 | 8990 | " |
| 3 | OFC - clad 0.60% C steel | 10.5 | 9405 | " |
| 4 | 0.13% C steel clad with Cu containing 0.3% Sn | 12.4 | 9015 | " |
| Prior art | | | | |
| 5 | Tough pitch soft copper | 10.0 | 5500 | " |
| 6 | Cu-0.62% Sn alloy | 11.0 | 7230 | " |
| Comparative ex. | | | | |
| 7 | Aluminum | 4.0 | 3200 | Bad |
| 8 | OFC - clad 0.20% C steel | 10.0 | 8996 | Good |
| 9 | OFC - clad 0.01% C steel | 7.8 | 9026 | " |

TABLE 3

| No. | Material for conductor | Structure of conductor | Conductor outer dia. (mm) | Element conductor's characteristics (% IACS) | Element conductor's characteristics (kg/mm²) | Conductor weight (g/m) | Wire weight after covering (g/m) | Conductor tensile break load (kg) |
|---|---|---|---|---|---|---|---|---|
| Present invention | | | | | | | | |
| 1 | OFC - clad Inbar (36% Ni) | 7/0.127ϕ | 0.4 | 40.5 | 101.6 | 0.86 | 1.4 | 11.6 |
| 2 | OFC - clad Fe—Ni (42% Ni) | " | " | " | 78.6 | " | " | 8.5 |
| 3 | OFC - clad stainless (18% Cr-8% Ni) | " | " | " | 110.5 | " | " | 13.6 |
| 4 | OFC clad Fe—Ni (42% Ni) | " | " | 65.2 | 70.0 | 0.87 | 1.5 | 8.3 |
| 5 | OFC - clad stainless (18% Cr-8% Ni) | " | " | 58.6 | 105.0 | " | " | 13.0 |
| Prior art | | | | | | | | |
| 6 | Tough pitch soft copper | 7/0.26ϕ | 0.78 | 100 | 28 | 5.5 | 5.0 | 10.6 |
| 7 | Cu-0.62% Sn alloy | 7/0.20ϕ | 0.60 | 60 | 53 | 3.3 | 4.5 | 11.9 |
| Comparative ex. | | | | | | | | |
| 8 | Aluminum | 7/0.32ϕ | 0.96 | 63 | 23 | 1.5 | 5.0 | 4.2 |
| 9 | OFC - clad 17% Ni—Fe | 7/0.127ϕ | 0.4 | 32.6 | 72.0 | 0.86 | 1.4 | 11.0 |
| 10 | OFC - clad 6% Ni-7% Cr—Fe | " | " | 40.5 | 59.8 | " | " | 6.5 |
| 11 | OFC - clad 83% Ni—Fe | " | " | 60.0 | 51.0 | " | " | 6.3 |

| No. | Material for conductor | Terminal housing holding force (kg) | Flexing resistance | Solderability |
|---|---|---|---|---|
| Present invention | | | | |
| 1 | OFC - clad | 9.6 | 9590 | Good |

TABLE 3-continued

| | | | | |
|---|---|---|---|---|
| | Inbar (36% Ni) | | | |
| 2 | OFC - clad Fe—Ni (42% Ni) | 7.5 | 9330 | " |
| 3 | OFC - clad stainless (18% Cr-8% Ni) | 11.6 | 9960 | " |
| 4 | OFC - clad Fe—Ni (42% Ni) | 7.0 | 9050 | " |
| 5 | OFC - clad stainless (18% Cr-8% Ni) | 12.0 | 9860 | " |
| Prior art | | | | |
| 6 | Tough pitch soft copper | 10.0 | 5500 | " |
| 7 | Cu-0.62% Sn alloy | 11.0 | 7230 | " |
| Comparative ex. | | | | |
| 8 | Aluminum | 4.0 | 3200 | poor |
| 9 | OFC - clad 17% Ni—Fe | 10.0 | 2360 | Good |
| 10 | OFC - clad 6% Ni-7% Cr—Fe | 5.5 | 5960 | " |
| 11 | OFC - clad 83% Ni—Fe | 5.2 | 4360 | " |

What is claimed is:

1. An electric wire conductor for use in automobiles, made by a process which comprises providing a plurality of strands, each of said strands comprising a core made of steel containing 0.01–0.25 percent of carbon and at least one element selected from the group consisting of Si, Mn, Ni and Cr, and a surface covering formed by metallurgically bonding 20–80 percent by weight of oxygen free copper or copper alloy on the outer periphery of said core, each of said strands having a tensile strength of 60–120 kg/mm$^2$ and a conductivity of 25% or more under IACS, and twisting together at least seven of said strands to form a conductor having a total sectional area of 0.05–0.30 mm$^2$ and a breaking load of not less than 6 kg.

2. An electric wire conductor as claimed in claim 1, wherein the upper limit of the conductivity of each of said strands is 80 percent under IACS.

3. An electric wire conductor for use in automobiles, made by a process which comprises providing a plurality of strands, each of said strands comprising a core made of steel containing 0.25–0.85 percent of carbon and at least one element selected from the group consisting of Si, Mn, P, S, Ni and Cr, and a surface covering formed by metallurgically bonding 20–80 percent by weight of oxygen free copper or copper alloy on the outer periphery of said core, each of said strands having a tensile strength of 60–140 kg/mm$^2$ and a conductivity of 25% or more under IACS, and twisting together at least seven of said strands to form a conductor having a total sectional area of 0.05–0.30 mm$^2$ and a breaking load of not less than 6 kg.

4. An electric wire conductor as claimed in claim 3, wherein the upper limit of the conductivity of each of said strands is 80 percent IACS.

5. An electric wire conductor for use in automobiles, made by a process which comprises providing a plurality of strands, each of said strands comprising a core made of an iron alloy containing 20–80 percent by weight of one or more elements selected from the group consisting of Ni, Co, Cr, Si, Mn, Mo and Nb with the remainder being iron, and a surface covering formed by metallurgically bonding 25–80 percent by weight of oxygen free copper or copper alloy on the outer periphery of said core, each of said strands having a tensile strength of 60–140 kg/mm$^2$ and a conductivity of 25% or more under IACS, and twisting together at least seven of said strands to form a conductor having a total sectional area of 0.05–0.30 mm$^3$ and a breaking load of not less than 6 kg.

6. An electric wire conductor as claimed in claim 5, wherein the upper limit of the conductivity of each of said strands is 80 percent IACS.

* * * * *